US011002260B2

(12) United States Patent
Chang et al.

(10) Patent No.: US 11,002,260 B2
(45) Date of Patent: May 11, 2021

(54) LIQUID PUMP CAPABLE OF ACHIEVING PRESSURE EQUILIBRIUM

(71) Applicant: FANER AROMA PRODUCT CO., LTD., Guangzhou (CN)

(72) Inventors: Hsu-Hui Chang, New Taipei (TW); Lu-Qiang Lin, Guangzhou (CN)

(73) Assignee: FANER AROMA PRODUCT CO., LTD., Guangzhou (CN)

( * ) Notice: Subject to any disclaimer, the term of this patent is extended or adjusted under 35 U.S.C. 154(b) by 280 days.

(21) Appl. No.: 16/388,985

(22) Filed: Apr. 19, 2019

(65) Prior Publication Data

US 2020/0332657 A1 Oct. 22, 2020

(51) Int. Cl.

| | |
|---|---|
| ***B05B 11/00*** | (2006.01) |
| ***F04B 7/00*** | (2006.01) |
| ***F04C 2/34*** | (2006.01) |
| ***A47K 5/12*** | (2006.01) |

(52) U.S. Cl.

CPC ..... *F04B 7/00* (2013.01); *A47K 5/1211* (2013.01); *B05B 11/00* (2013.01); *B05B 11/0005* (2013.01); *B05B 11/0062* (2013.01); *B05B 11/0064* (2013.01); *F04C 2/34* (2013.01); *A47K 5/12* (2013.01); *B05B 11/00442* (2018.08); *B05B 11/305* (2013.01); *B05B 11/3015* (2013.01);

(Continued)

(58) Field of Classification Search

CPC .... F04B 7/00; B05B 11/0064; B05B 11/0062; B05B 11/0005; B05B 11/00; B05B 11/3015; B05B 11/3069; B05B 11/00442; B05B 11/305; B05B 11/3074; A47K 5/1211; A47K 5/12; F04C 2/34; F04C 14/22; F04C 15/0003; F01C 20/18

See application file for complete search history.

(56) References Cited

U.S. PATENT DOCUMENTS 3,258,175 A * 6/1966 Taylor ..... B05B 11/0075 222/380

3,485,419 A * 12/1969 Taylor ..... B05B 11/0075 222/340

(Continued)

*Primary Examiner* — Frederick C Nicolas

(74) *Attorney, Agent, or Firm* — Schmeiser, Olsen & Watts, LLP

(57) ABSTRACT

A liquid pump capable of achieving pressure equilibrium includes a body, piston member, unidirectional input valve, unidirectional output valve, input inner-pipe, unidirectional gas-feeding hermetic-seal valve and input outer-pipe. The body has an input opening, output opening and piston opening. The piston member has a piston space communicating with the piston opening. The unidirectional input valve includes an input plug and input resilient element. The input plug abuts against the input opening. The unidirectional output valve includes an output plug and output resilient element. The output plug abuts against the output opening from outside. An input channel of the input inner-pipe communicates with the input opening. Direction of gas-flow between the unidirectional gas-feeding hermetic-seal valve and the input inner-pipe is opposite input direction of the input channel. The input outer-pipe has an input portion communicating with the input channel. A gas-feeding-channel is defined between a gas-feeding-portion and the input inner-pipe.

10 Claims, 6 Drawing Sheets

(52) U.S. Cl.
CPC ..... *B05B 11/3069* (2013.01); *B05B 11/3074* (2013.01)

(56) References Cited

U.S. PATENT DOCUMENTS 4,174,056 A * 11/1979 Loeffler ..... B05B 11/3004 222/321.7
5,052,587 A * 10/1991 Graves ..... F41B 9/004 222/79
5,704,550 A * 1/1998 Foster ..... B05B 1/3431 239/333
5,711,461 A * 1/1998 Foster ..... B05B 11/0064 222/383.1
6,253,961 B1 * 7/2001 Anderson ..... B05B 11/3002 222/83
6,364,170 B1 * 4/2002 Anderson ..... B05B 11/0097 222/321.7
9,211,558 B1 * 12/2015 Pierson ..... B05B 11/3015
2009/0071977 A1 * 3/2009 Abe ..... B05B 11/3015 222/105
2019/0022711 A1 * 1/2019 Chang ..... A47L 15/4436
2021/0052115 A1 * 2/2021 Casper ..... A47K 5/1211

* cited by examiner

LIQUID PUMP CAPABLE OF ACHIEVING PRESSURE EQUILIBRIUM

BACKGROUND OF THE INVENTION

1. Field of the Invention

The present disclosure relates to liquid pumps and, more particularly, to a liquid pump capable of achieving pressure equilibrium.

2. Description of the Related Art

Liquid pumps are devices for moving a fluid. A conventional spring pump has an input pipe and an output pipe in communication with the input pipe. A non-return valve is disposed between the input pipe and the output pipe. The space within the spring pump is compressed with a piston therein to change the pressure within the space and thereby liquid is drawn out of a container through the input pipe and the output pipe. Afterward, the piston returns to its initial position by a spring. The aforesaid mechanical structure is unlikely to get damaged and is reusable for a long period of time.

However, in the course of drawing liquid out of a container and conveying the liquid with a liquid pump to another place, internal pressure of the container decreases gradually, rendering it increasingly difficult to operate the liquid pump. Furthermore, the amount of the liquid drawn in each instance of pumping is unstable. If a hole is formed on the container or a circulation route in order to supply external air to the container and thus maintain its internal pressure, the liquid is likely to leak through the hole to the detriment of external environment and user safety.

BRIEF SUMMARY OF THE INVENTION

The objective of the present disclosure is to provide a liquid pump capable of achieving equilibrium between pressure inside and pressure outside a container, maintaining stable quantity of liquid output, and preventing leakage of liquid.

In order to achieve the above and other objectives, the present disclosure provides a liquid pump capable of achieving pressure equilibrium, comprising: a body having therein a main space, the main space having an input opening, an output opening and a piston opening; a piston member comprising a piston cylinder and a piston push rod, the piston cylinder having a piston space in communication with the main space through the piston opening, and the piston push rod being disposed in the piston space and sliding in an extension direction of the piston cylinder; a unidirectional input valve comprising an input plug and an input resilient element connected to the input plug, the input plug abutting against the input opening, and the input resilient element abutting against the body; a unidirectional output valve comprising an output plug and an output resilient element connected to the output plug, the output plug abutting against the output opening, and the output resilient element abutting against the body; an input inner pipe having an input channel with an end in communication with the input opening; a unidirectional gas-feeding hermetic seal valve fitting around the input inner pipe, wherein direction of gas flow between the unidirectional gas-feeding hermetic seal valve and the input inner pipe is opposite input direction of the input channel; and an input outer pipe containing the input inner pipe and the unidirectional gas-feeding hermetic seal valve and having an input portion and a gas-feeding portion surrounding the input portion, the input portion being in communication with another end of the input channel of the input inner pipe, wherein a gas-feeding channel is defined by and between the gas-feeding portion and the input inner pipe, the gas-feeding portion having a gas-feeding opening in communication with the gas-feeding channel and a gas-discharging opening, wherein the unidirectional gas-feeding hermetic seal valve is disposed between the gas-feeding opening and the gas-discharging opening.

In an embodiment of the present disclosure, the piston member further comprises a retract spring disposed between the piston cylinder and the piston push rod.

In an embodiment of the present disclosure, the piston member further comprises a piston hermetic seal ring fitting around the piston push rod.

In an embodiment of the present disclosure, the piston push rod has at least one engaging arm, and the piston cylinder has at least one engaging slot, with the engaging arm slidingly engaged with the engaging slot.

In an embodiment of the present disclosure, the input resilient element of the unidirectional input valve is configured in such a manner that compression direction is equivalent to an input direction of the input channel.

In an embodiment of the present disclosure, the body extends from the output opening to form an output tube, and the unidirectional output valve is disposed at an end of the output tube.

In an embodiment of the present disclosure, the output resilient element of the unidirectional output valve is configured in such a manner that compression direction is equivalent to an output direction of the output tube.

In an embodiment of the present disclosure, the liquid pump further comprises an atomization member disposed at the other end of the output tube.

In an embodiment of the present disclosure, the liquid pump further comprises an atomization cover and a cover hermetic seal ring, and the atomization cover has a hole corresponding in position to the atomization member, with the atomization cover disposed outside the output tube and the atomization member to fix the atomization member in place, and with the cover hermetic seal ring disposed between the atomization cover and the output tube.

In an embodiment of the present disclosure, the body further comprises a fitting upper cover and a fitting lower cover, wherein the main space is defined by and between the fitting upper cover and the fitting lower cover, the input opening being disposed at the fitting upper cover, and the output opening being disposed at the fitting lower cover.

In an embodiment of the present disclosure, the unidirectional input valve further comprises a support element disposed between the fitting upper cover and the fitting lower cover, and the input resilient element of the unidirectional input valve is disposed in the support element.

In an embodiment of the present disclosure, the liquid pump further comprises a hermetic seal ring fitting between the input inner pipe and the body.

In an embodiment of the present disclosure, the liquid pump further comprises a container mouth hermetic seal plug fitting around the input portion of the input outer pipe, and the gas-discharging opening is communicatively disposed between the container mouth hermetic seal plug and the input portion.

In an embodiment of the present disclosure, the body further comprises at least one pump proper fastener disposed on one side of the body.

Therefore, according to the present disclosure, the liquid pump capable of achieving pressure equilibrium has advantages as follows: the piston push rod is pushed and pulled under an applied force repeatedly to thereby continuously draw liquid out of the container through the body; the amount of liquid output in each instance of pumping is stable and fixed; and in the course of transferring the liquid, not only is the pressure inside and outside the container kept stable, but the container is also unlikely to deform or crack, not to mention that leakage of liquid is unlikely to occur, thereby ensuring user safety.

DETAILED DESCRIPTION OF THE INVENTION

Objectives, features, and advantages of the present disclosure are hereunder illustrated with specific embodiments, depicted with drawings, and described below.

Figure 1:
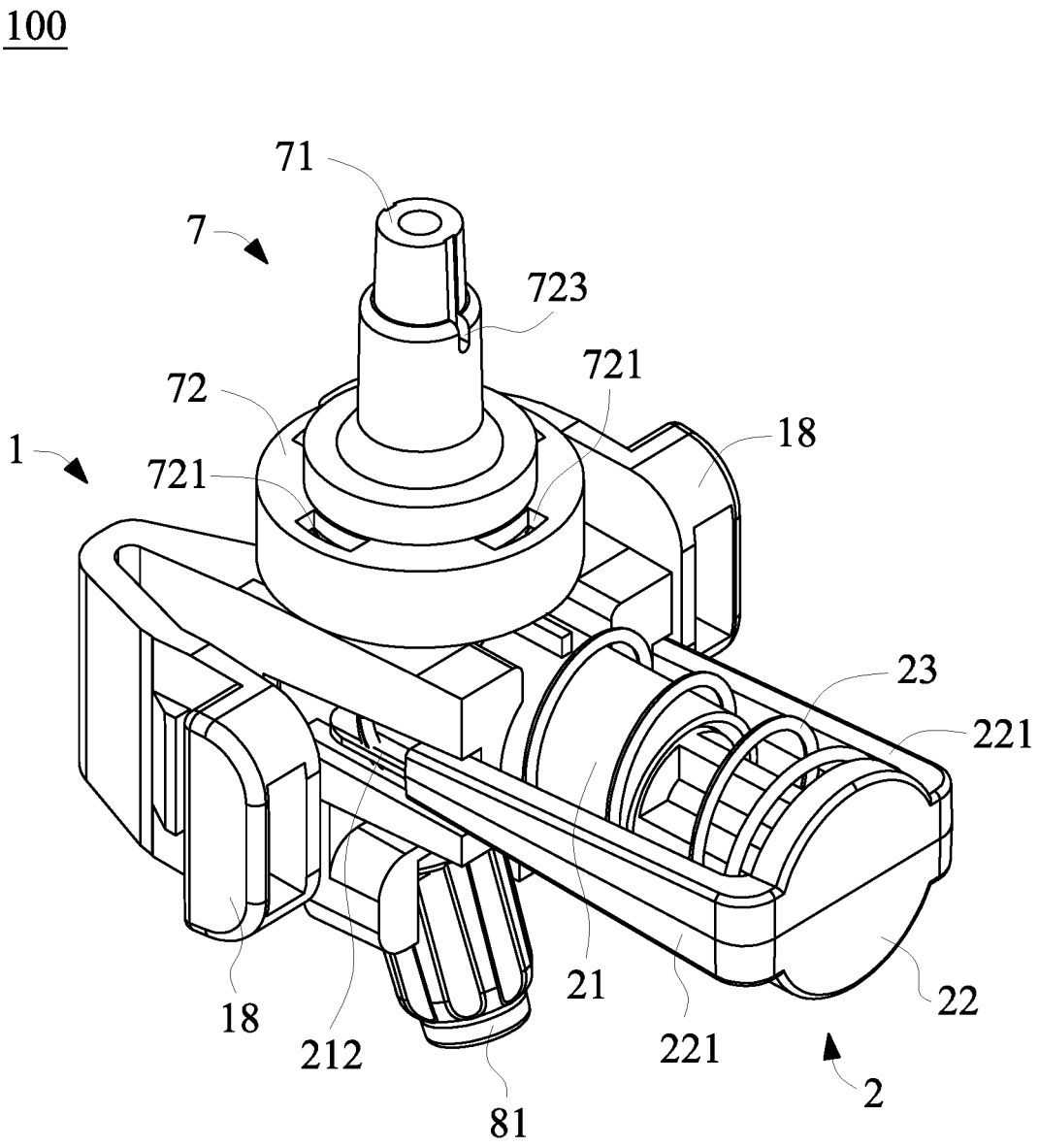
FIG. 1 is a perspective view of a liquid pump capable of achieving pressure equilibrium according to a preferred embodiment of the present disclosure.
Figure 2:
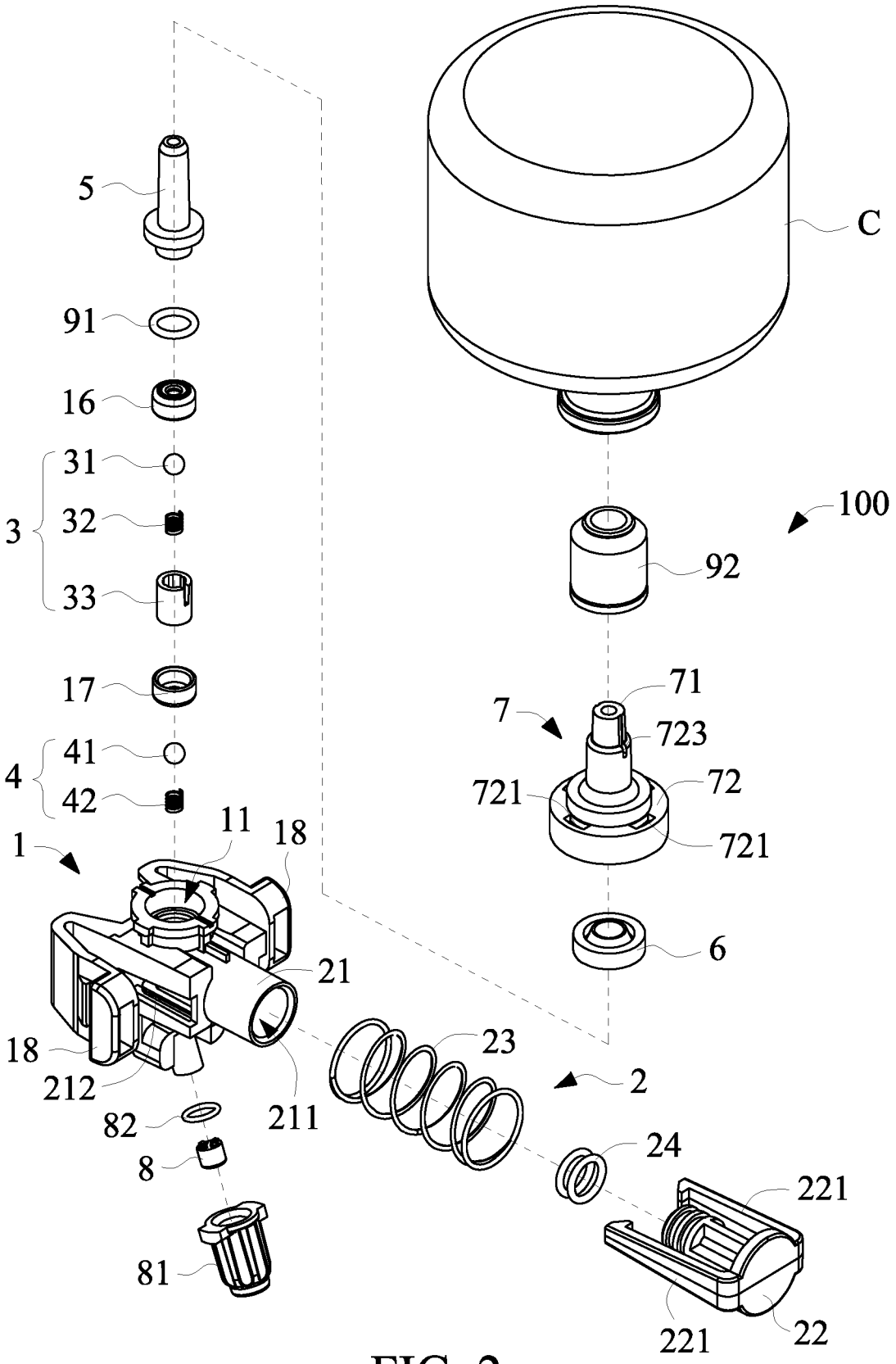
FIG. 2 is an exploded view of the liquid pump capable of achieving pressure equilibrium according to a preferred embodiment of the present disclosure.
Figure 3:
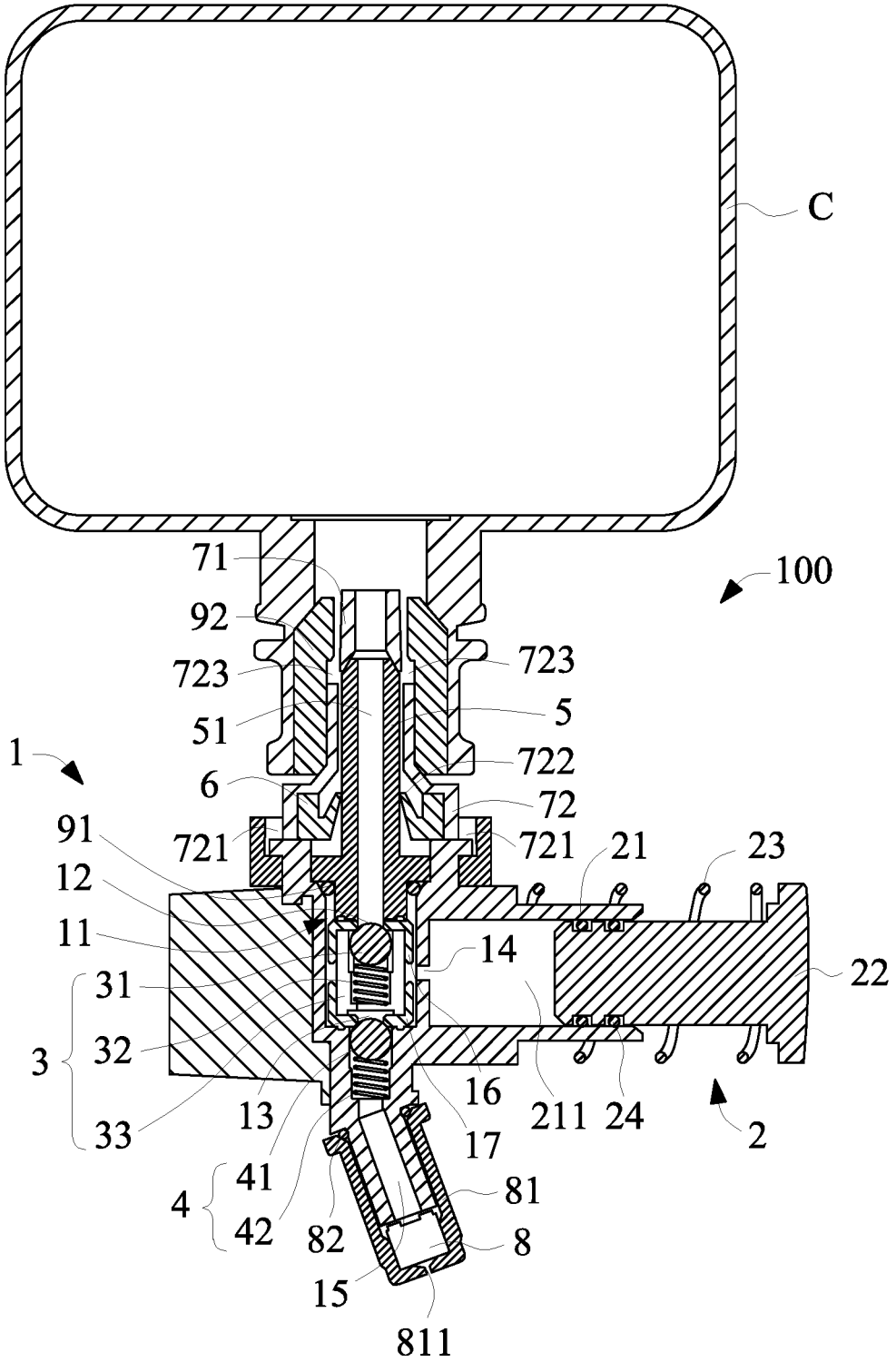
FIG. 3 is a cross-sectional view of the liquid pump capable of achieving pressure equilibrium according to a preferred embodiment of the present disclosure.

Referring to FIG. 1 through FIG. 3, a liquid pump 100 capable of achieving pressure equilibrium according to the present disclosure comprises a body 1, a piston member 2, a unidirectional input valve 3, a unidirectional output valve 4, an input inner pipe 5, a unidirectional gas-feeding hermetic seal valve 6 and an input outer pipe 7.

The body 1 has therein a main space 11. The main space 11 has an input opening 12, an output opening 13 and a piston opening 14.

The piston member 2 comprises a piston cylinder 21 and a piston push rod 22. The piston cylinder 21 has a piston space 211 in communication with the main space 11 through the piston opening 14. The piston push rod 22 is disposed in the piston space 211 and slides along the extension direction of the piston cylinder 21.

The unidirectional input valve 3 is disposed in the main space 11. The unidirectional input valve 3 comprises an input plug 31 and an input resilient element 32 with one end connected to the input plug 31. The input plug 31 abuts against the input opening 12 from inside the main space 11. The input resilient element 32 is abuttingly disposed inside the body 1. In this embodiment, the input plug 31 is spherical, and the input resilient element 32 is a spring, but the present disclosure is not limited thereto.

The unidirectional output valve 4 is disposed outside the main space 11. The unidirectional output valve 4 comprises an output plug 41 and an output resilient element 42 with one end connected to the output plug 41. The output plug 41 abuts against the output opening 13 from outside the main space 11. The output resilient element 42 is abuttingly disposed inside the body 1. In this embodiment, the output plug 41 is spherical, and the output resilient element 42 is a spring, but the present disclosure is not limited thereto.

The input inner pipe 5 has an input channel 51. One end of the input channel 51 is in communication with the input opening 12.

The unidirectional gas-feeding hermetic seal valve 6 fits around the input inner pipe 5. Referring to FIG. 3, the unidirectional gas-feeding hermetic seal valve 6 is an annular hermetic seal element which permits passage of gas/liquid in one single direction and stops reverse passage of the gas/liquid. According to the present disclosure, the unidirectional gas-feeding hermetic seal valve 6 is configured in such a manner that the direction of gas flow between the unidirectional gas-feeding hermetic seal valve 6 and the input inner pipe 5 is opposite the input direction of the input channel 51.

The input inner pipe 5 and the unidirectional gas-feeding hermetic seal valve 6 are disposed in the input outer pipe 7. The input outer pipe 7 has an input portion 71 and a gas-feeding portion 72 surrounding the input portion 71. The input portion 71 has therein a channel in communication with the other end of the input channel 51 of the input inner pipe 5. a gas-feeding channel 722 is defined by and between the gas-feeding portion 72 and the input inner pipe 5. The gas-feeding portion 72 has a gas-feeding opening 721 and a gas-discharging opening 723 in communication with the gas-feeding channel 722. The unidirectional gas-feeding hermetic seal valve 6 is disposed between the gas-feeding opening 721 and the gas-discharging opening 723.

Figure 4:
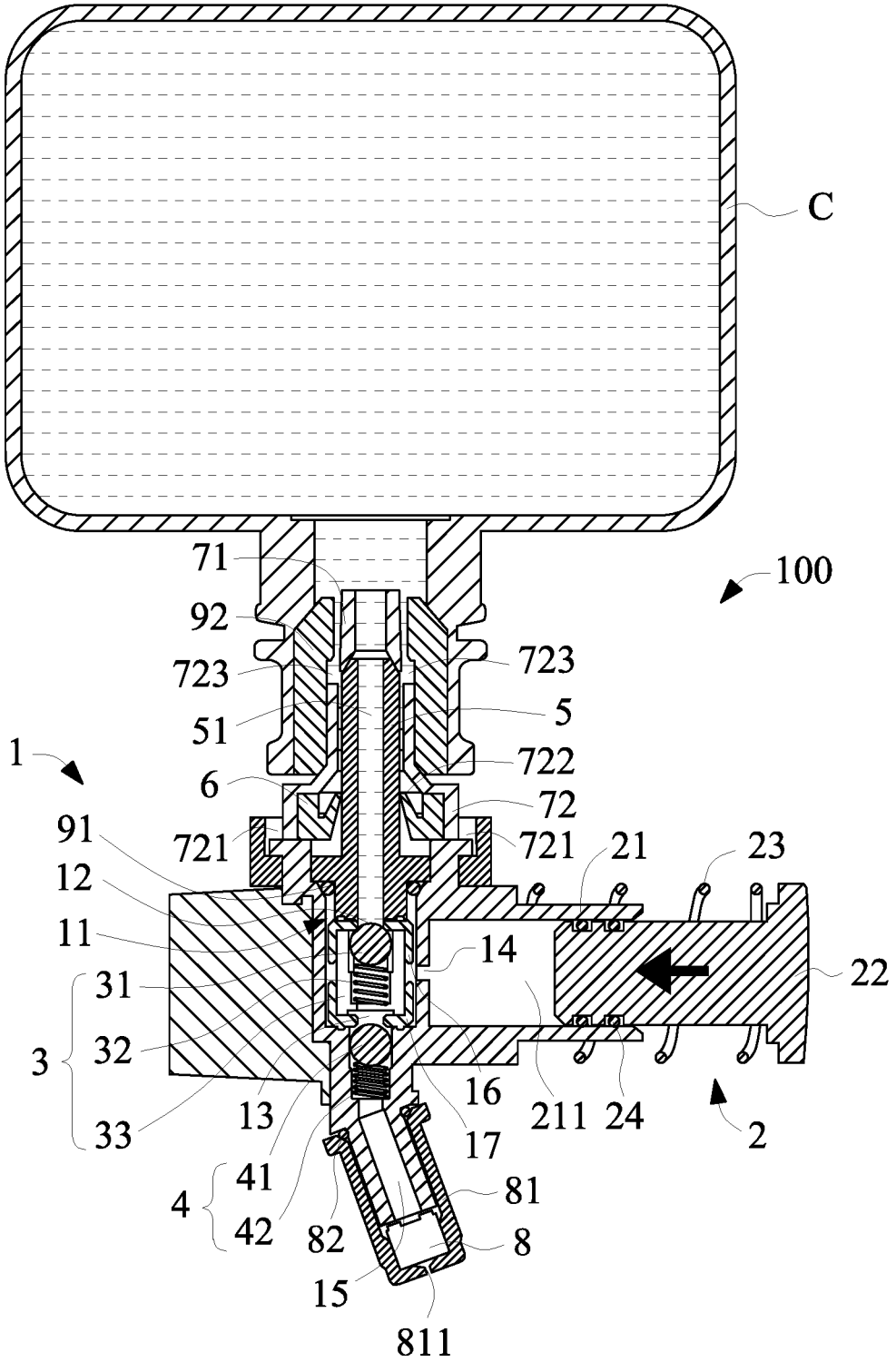
FIG. 4 is a cross-sectional view about how to operate the liquid pump capable of achieving pressure equilibrium according to a preferred embodiment of the present disclosure.
Figure 5:
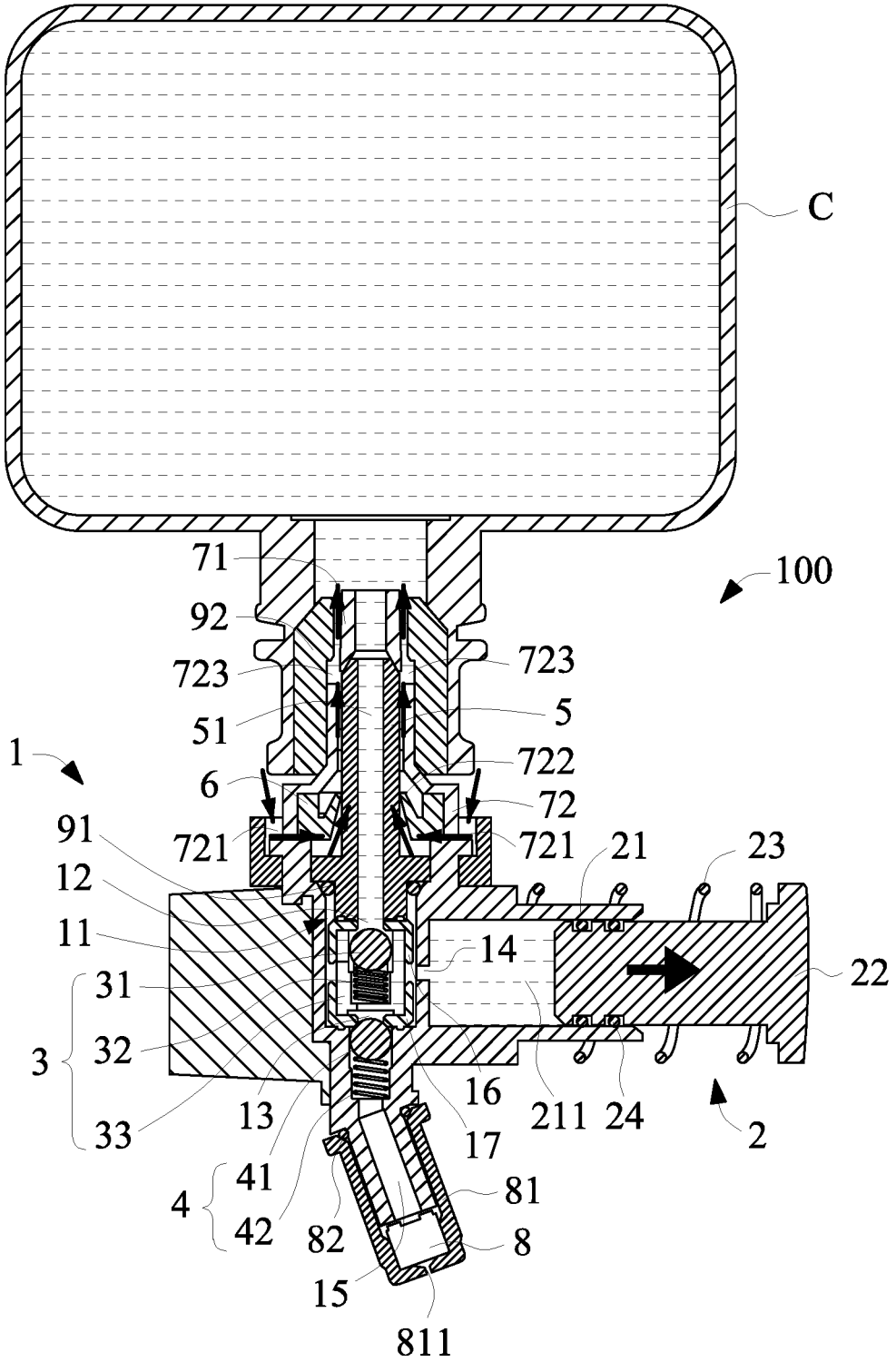
FIG. 5 is a cross-sectional view about how to operate the liquid pump capable of achieving pressure equilibrium according to a preferred embodiment of the present disclosure.
Figure 6:
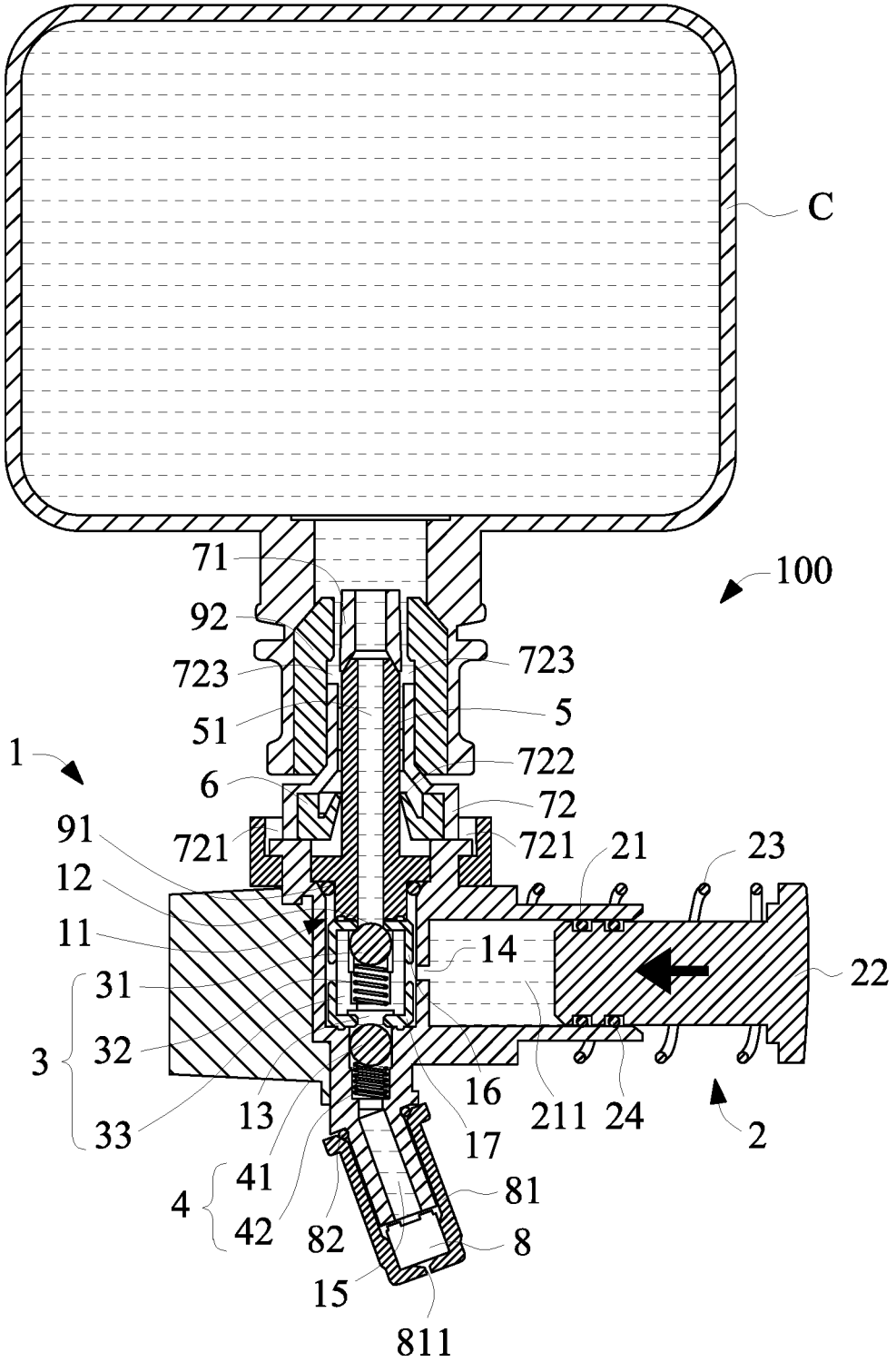
FIG. 6 is a cross-sectional view about how to operate the liquid pump capable of achieving pressure equilibrium according to a preferred embodiment of the present disclosure.

FIG. 4 through FIG. 6 show how to operate the liquid pump 100 capable of achieving pressure equilibrium according to the present disclosure.

Referring to FIG. 4, the input outer pipe 7 of the liquid pump 100 capable of achieving pressure equilibrium is connected to a container C filled with liquid. The liquid sequentially flows into a channel of the input portion 71 and the input channel 51 and thus is denied entry into the input opening 12 by the input plug 31. At this point in time, the liquid is absent from the main space 11 and the piston space 211. Then, the piston push rod 22 is pushed under an external force to move in the direction indicated by the arrow shown in FIG. 4 such that the pressure inside the main space 11 increase; hence, the input plug 31 inside the main space 11 is pressed and compressed, whereas the output plug 41 outside the main space 11 exits the output opening 13 when pushed under the atmospheric pressure, allowing the gas of the main space 11 to be discharged from the output opening 13, thereby compressing the output resilient element 42 of the unidirectional output valve 4.

Referring to FIG. 5, the piston push rod 22 is pulled back. At this point in time, the gas pressure inside the main space 11 decreases, and thus the output plug 41 abuts against the output opening 13. When the difference between the liquid pressure of the input channel 51 and the gas pressure inside the main space 11 overcomes the resilient restoring force of the input resilient element 32, the input plug 31 is forced out of the input opening 12 such that the liquid of the input channel 51 flows into the main space 11 through the input opening 12 and flows into the piston space 211 through the piston opening 14. At this point in time, the input resilient element 32 of the unidirectional input valve 3 is compressed.

Since the liquid of the container C flows into the main space 11 through the input channel 51, external air enters the input outer pipe 7 through the gas-feeding opening 721 disposed on the gas-feeding portion 72 of the input outer pipe 7, and then the external air enters the container C through the unidirectional gas-feeding hermetic seal valve 6, the gas-feeding channel 722 defined by and between the gas-feeding portion 72 and the input inner pipe 5, and the gas-discharging opening 723 sequentially such that the internal pressure and external pressure of the container C are stable continuously. In this embodiment, the gas-discharging opening 723 is disposed between the input portion 71 and the gas-feeding portion 72 such that gas enters the container C after passing through the gas-discharging opening 723 and then flowing along a channel between the outer wall of the input portion 71 and the mouth of the container C.

Referring to FIG. 6, when the main space 11 and the piston space 211 are filled with the liquid such that the difference between the internal pressure and external pressure of the main space 11 can no longer overcome the resilient restoring force of the input resilient element 32, the input plug 31 abuts against the input opening 12 and thereby prevents the continuous inflow of the liquid. At this point in time, the piston push rod 22 is pushed again under an external force to move in the direction indicated by the arrow shown in FIG. 6, and in consequence under the liquid pressure the output plug 41 is forced out of the output opening 13, allowing the liquid to be discharged from the output opening 13.

When the liquid pressure inside the main space 11 can no longer overcome the resilient restoring force of the output resilient element 42, the output plug 41 abuts against the output opening 13. At this point in time, the piston push rod 22 is pulled in the opposite direction, thereby supplying the liquid to the main space 11 and the piston space 211.

By pushing and pulling the piston push rod 22 repeatedly under an external force, the liquid of the container C can be continuously output through the body 1. In the course of outputting the liquid, not only do the internal pressure and external pressure of the container C remain stable to thereby preclude leakage of the liquid, but the amount of the liquid output in each instance is also stable and fixed.

Referring to FIG. 1 through FIG. 3, in an embodiment of the present disclosure, the piston member 2 further comprises a retract spring 23 disposed between the piston cylinder 21 and the piston push rod 22. Under the resilient restoring force of the retract spring 23, after the user has pushed and pressed the piston push rod 22, resilient potential energy stored as a result of compression of the retract spring 23 enables the piston push rod 22 to automatically return to the initial position, thereby rendering the operation more automatic and convenient.

Referring to FIG. 2 and FIG. 3, in an embodiment of the present disclosure, the piston member 2 further comprises a piston hermetic seal ring 24 which fits around the piston push rod 22 such that no gap is present between the piston cylinder 21 and the piston push rod 22, thereby precluding leakage of the liquid.

Referring to FIG. 1, FIG. 2, in an embodiment of the present disclosure, the piston push rod 22 has at least one engaging arm 221, and the piston cylinder 21 has at least one engaging slot 212. The engaging arm 221 is slidingly engaged with the engaging slot 212 to prevent the piston push rod 22 from separating from the piston cylinder 21.

Referring to FIG. 5, in an embodiment of the present disclosure, the input resilient element 32 of the unidirectional input valve 3 is configured in such a manner that the compression direction is equivalent to the input direction of the input channel 51. Therefore, the input resilient element 32 is readily compressed under a gas/liquid pressure difference.

Referring to FIG. 3, in an embodiment of the present disclosure, the body 1 extends from the output opening 13 to form an output tube 15, whereas the unidirectional output valve 4 is disposed at one end of the output tube 15. The output tube 15 enables the unidirectional output valve 4 to be firmly disposed therein. The output tube 15 is integrally formed or consists of two components fitted together.

Referring to FIG. 4, FIG. 6, in an embodiment of the present disclosure, the output resilient element 42 of the unidirectional output valve 4 is configured in such a manner that the compression direction is equivalent to the output direction of the output tube 51. Therefore, the output resilient element 42 is readily compressed under a gas/liquid pressure difference.

Referring to FIG. 2 and FIG. 3, in an embodiment of the present disclosure, the liquid pump further comprises an atomization member 8 disposed at the other end of the output tube 51, and the atomization member 8 is a block with pores. Owing to the atomization member 8, the liquid is turned into droplets and thus atomized.

Referring to FIG. 1 through FIG. 3, in an embodiment of the present disclosure, the liquid pump further comprises an atomization cover 81 and a cover hermetic seal ring 82. The atomization cover 81 has a hole 811 corresponding in position to the atomization member 8. The atomization cover 81 is disposed outside the output tube 15 and the atomization member 8 to therefore fix the atomization member 8 in place. The cover hermetic seal ring 82 is disposed between the atomization cover 81 and the output tube 15 to preclude leakage of the liquid.

Referring to FIG. 2 and FIG. 3, in an embodiment of the present disclosure, the body 1 further comprises a fitting upper cover 16 and a fitting lower cover 17. The main space 11 is defined by and between the fitting upper cover 16 and the fitting lower cover 17. The input opening 12 is disposed at the fitting upper cover 16. The output opening 13 is disposed at the fitting lower cover 17. To facilitate assembly and manufacturing, a large slot is formed on the body 1, and then the unidirectional output valve 4, the fitting lower cover 17, the unidirectional input valve 3 and the fitting upper cover 16 are sequentially mounted on the large slot of the body 1 to form the main space 11. Therefore, it is easier for the unidirectional input valve 3 and unidirectional output valve 4 to be embedded and thus disposed in the body 1.

Referring to FIG. 2 and FIG. 3, in an embodiment of the present disclosure, the unidirectional input valve 3 further comprises a support element 33. The support element 33 is disposed between the fitting upper cover 16 and the fitting lower cover 17. The input resilient element 32 of the unidirectional input valve 3 is disposed in the support element 33. The support element 33 is a tube with pores. Therefore, the input resilient element 32 is firmly fixed to the support element 33. The fitting upper cover 16 and the fitting lower cover 17 are separated by a distance to thereby allow the gas/liquid to flow from the piston space 211 to the main space 11 through the piston opening 14 and flow from the main space 11 to the piston space 211 through the piston opening 14.

Referring to FIG. 2 and FIG. 3, in an embodiment of the present disclosure, the liquid pump further comprises a hermetic seal ring 91 which fits between the input inner pipe 5 and the body 1. Therefore, the input inner pipe 5 and the body 1 are connected tightly.

Referring to FIG. 2 and FIG. 3, in an embodiment of the present disclosure, the liquid pump further comprises a container mouth hermetic seal plug 92 which fits around the input portion 71 of the input outer pipe 7, whereas the gas-discharging opening 723 is communicatively disposed between the container mouth hermetic seal plug 92 and the input portion 71. In this embodiment, the gas is supplied to the container C by passing through the gas-discharging opening 723 and then flowing along a channel defined by and between the outer wall of the input portion 71 and the container mouth hermetic seal plug 92. The container mouth hermetic seal plug 92 is adapted to function as a connection element between the container C and the input outer pipe 7 and is variable in size and shape, depending on the size and shape of a communicative tubular space inside the container C. Therefore, the liquid pump 100 capable of achieving pressure equilibrium according to the present disclosure is suitable for the container C of any type.

Referring to FIG. 1 and FIG. 2, in an embodiment of the present disclosure, the body 1 further comprises at least one pump proper fastener 18 disposed on one side of the body 1. Owing to the pump proper fastener 18, the liquid pump 100 capable of achieving pressure equilibrium according to the present disclosure can be fixed to any other device, rendering the operation more convenient but less laborious.

While the present disclosure has been described by means of specific embodiments, numerous modifications and variations could be made thereto by those skilled in the art without departing from the scope and spirit of the present disclosure set forth in the claims.

What is claimed is:

1. A liquid pump capable of achieving pressure equilibrium, comprising:

a body having therein a main space, the main space having an input opening, an output opening and a piston opening;

a piston member comprising a piston cylinder and a piston push rod, the piston cylinder having a piston space in communication with the main space through the piston opening, and the piston push rod being disposed in the piston space and sliding in an extension direction of the piston cylinder;

a unidirectional input valve comprising an input plug and an input resilient element connected to the input plug, the input plug abutting against the input opening, and the input resilient element abutting against the body;

a unidirectional output valve comprising an output plug and an output resilient element connected to the output plug, the output plug abutting against the output opening, and the output resilient element abutting against the body;

an input inner pipe having an input channel with an end in communication with the input opening;

a unidirectional gas-feeding hermetic seal valve fitting around the input inner pipe, wherein direction of gas flow between the unidirectional gas-feeding hermetic seal valve and the input inner pipe is opposite input direction of the input channel; and an input outer pipe containing the input inner pipe and the unidirectional gas-feeding hermetic seal valve and having an input portion and a gas-feeding portion surrounding the input portion, the input portion being in communication with another end of the input channel of the input inner pipe, wherein a gas-feeding channel is defined by and between the gas-feeding portion and the input inner pipe, the gas-feeding portion having a gas-feeding opening in communication with the gas-feeding channel and a gas-discharging opening, wherein the unidirectional gas-feeding hermetic seal valve is disposed between the gas-feeding opening and the gas-discharging opening.

2. The liquid pump of claim 1, wherein the piston member further comprises a retract spring disposed between the piston cylinder and the piston push rod.

3. The liquid pump of claim 1, wherein the piston push rod has at least one engaging arm, and the piston cylinder has at least one engaging slot, with the engaging arm slidingly engaged with the engaging slot.

4. The liquid pump of claim 1, wherein the input resilient element of the unidirectional input valve is configured in such a manner that compression direction is equivalent to an input direction of the input channel.

5. The liquid pump of claim 1, wherein the body extends from the output opening to form an output tube, and the unidirectional output valve is disposed at an end of the output tube.

6. The liquid pump of claim 5, wherein the output resilient element of the unidirectional output valve is configured in such a manner that compression direction is equivalent to an output direction of the output tube.

7. The liquid pump of claim 1, wherein the body further comprises a fitting upper cover and a fitting lower cover, with the main space defined by and between the fitting upper cover and the fitting lower cover, the input opening being disposed at the fitting upper cover, and the output opening being disposed at the fitting lower cover.

8. The liquid pump of claim 7, wherein the unidirectional input valve further comprises a support element disposed between the fitting upper cover and the fitting lower cover, and the input resilient element of the unidirectional input valve is disposed in the support element.

9. The liquid pump of claim 1, further comprising a container mouth hermetic seal plug fitting around the input portion of the input outer pipe, and the gas-discharging opening is communicatively disposed between the container mouth hermetic seal plug and the input portion.

10. The liquid pump of claim 1, wherein the body further comprises at least one pump proper fastener disposed on a side of the body.

* * * * *